US006155278A

United States Patent [19]

Lin

[11] Patent Number: 6,155,278

[45] Date of Patent: Dec. 5, 2000

[54] VENTILATED UMBRELLA

[76] Inventor: Yao-Chin Lin, No. 21, Alley 24, Lane 273, Sec. 3 Tungmen Rd., Tainan, Taiwan

[21] Appl. No.: 09/290,253

[22] Filed: Apr. 13, 1999

[30] Foreign Application Priority Data

Mar. 19, 1999 [TW] Taiwan ..... 88204120

[51] Int. Cl.[7] ..... A45B 25/26; A45B 25/22

[52] U.S. Cl. ..... 135/33.7; 135/27; 135/33.4

[58] Field of Search ..... 135/33.7, 27, 15.1, 135/33.2, 33.4

[56] References Cited

U.S. PATENT DOCUMENTS

| | | | |
|---|---|---|---|
| 305,030 | 9/1884 | Apfelbaum | 135/35.2 |
| 5,078,166 | 1/1992 | Lee | 135/33.7 |
| 5,115,827 | 5/1992 | Lee | 135/33.7 |
| 5,601,103 | 2/1997 | Dubinsky | 135/33.7 |
| 6,006,769 | 12/1999 | Lin | 135/33.7 |
| 6,039,063 | 3/2000 | Lin et al. | 135/33.7 |

FOREIGN PATENT DOCUMENTS

| | | | |
|---|---|---|---|
| 106457 | 5/1927 | Germany | 135/33.7 |

*Primary Examiner*—Robert Canfield
*Attorney, Agent, or Firm*—Jackson Walker L.L.P.

[57] ABSTRACT

A ventilated umbrella includes a support frame forming a fully expand surface when it is fully expanded, a first canopy secured on the inner area of the fully expanded surface of the support frame and having an outer edge, and a band-shaped second canopy secured on the outer area of the fully expanded surface of the support frame and slightly overlapped by the first canopy. The second canopy has an inner edge located under the outer edge of the first canopy, and multiple extensions strips each extending inward from the inner edge of the second canopy, and each secured to the support frame. In such a manner, the gap between the outer edge of the first canopy and the inner edge of the second canopy is enlarged by stretching each of the extension strips, thereby enhancing the ventilating effect.

6 Claims, 7 Drawing Sheets

VENTILATED UMBRELLA

CROSS-REFERENCES TO RELATED APPLICATIONS

Not Applicable.

BACKGROUND OF THE INVENTION

1. Field of the Invention

The present invention relates to a ventilated umbrella.

2. Description of the Related Art

A first conventional ventilated umbrella in accordance with the prior art shown in FIG. 7 comprises a support frame (40) having multiple ribs (41), and a composite canopy (3) attached to the support frame (40). The composite canopy (3) includes a main canopy (30) attached to the ribs (41) of the support frame (40) and contains multiple openings (301), and an auxiliary canopy (31) mounted on the main canopy (30) to cover the openings (301). In such a manner, air can flow through the gap defined between the main canopy (30) and the outer edge (311) of the auxiliary canopy (31) into the openings (301), thereby enhancing the ventilating effect of the umbrella. However, the auxiliary canopy (3 1) snugly abuts the main canopy (30) when the support frame (40) is fully expanded such that the gap between the main canopy (30) and the outer edge (311) of the auxiliary canopy (31) is too small to allow the air access to the openings (301), thereby decreasing the ventilation effect. In addition, the auxiliary canopy (31) significantly overlaps the main canopy (30), thereby increasing the cost of manufacturing.

A second conventional ventilated umbrella in accordance with the prior art shown in FIG. 8 comprises a support frame (60) having multiple ribs (61), and a composite canopy (5) attached to the support frame (60). The composite canopy (5) includes a main canopy (50) attached to the ribs (61) of the support frame (60) and contains therein an opening (500) in which a net (501) is mounted, and an auxiliary canopy (51) mounted on the main canopy (50) to cover the net (501). In such a manner, air can flow through the gap defined between the main canopy (50) and the outer edge (511) of the auxiliary canopy (51) into the net (501), thereby enhancing the ventilating effect of the umbrella. However, the auxiliary canopy (51) snugly abuts the main canopy (50) when the support frame (60) is fully expanded such that the gap between the main canopy (50) and the outer edge (511) of the auxiliary canopy (51) is too small to allow the air access to the net (501), thereby decreasing the ventilating effect. In addition, the auxiliary canopy (51) significantly overlaps the main canopy (50), thereby increasing the cost of manufacturing.

The present invention has arisen to mitigate and/or obviate the disadvantage of the conventional ventilated umbrellas.

BRIEF SUMMARY OF THE INVENTION

In accordance with one aspect of the present invention, there is provided a ventilated umbrella comprising a support frame forming a fully expanding surface when it is fully expanded, a first canopy secured on the inner edge of the fully expanding surface of the support frame and having an outer edge, and a band-shaped second canopy secured on the outer edge of the full expanding surface of the support frame and partially overlapped by the first canopy. The second canopy has an inner edge located under the outer edge of the first canopy, and has multiple extension strips each extending inward from the inner edge thereof, and each secured to the support frame. Each of the extension strips has a tapered shape that tapers toward the center of the second canopy.

The ventilated umbrella further comprises multiple reinforcing ropes attached to the support frame to reinforce the strength of the support frame.

In accordance with another aspect of the present invention, the support frame has a multi-folding structure.

In accordance with a further aspect of the present invention, the fully expanding surface of the support frame has a tetragonal shape, and each of the extension strips extends to the center of the second canopy.

Further benefits and advantages of the present invention will become apparent after a careful reading of the detailed description with appropriate reference to the accompanying drawings.

DETAILED DESCRIPTION OF THE INVENTION

Figure 1:
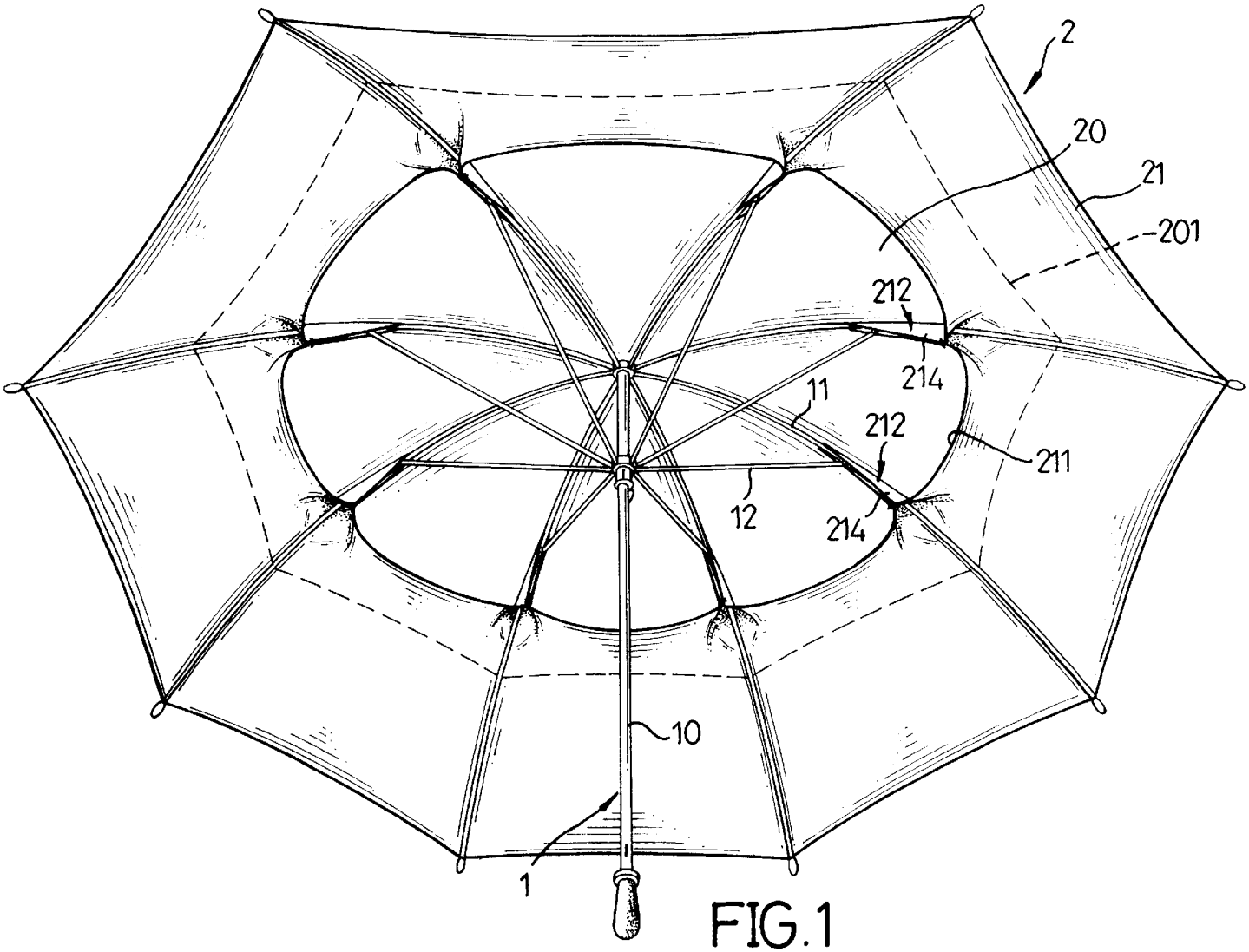
FIG. 1 is a bottom perspective view of a ventilated umbrella in accordance with the present invention.
Figure 2:
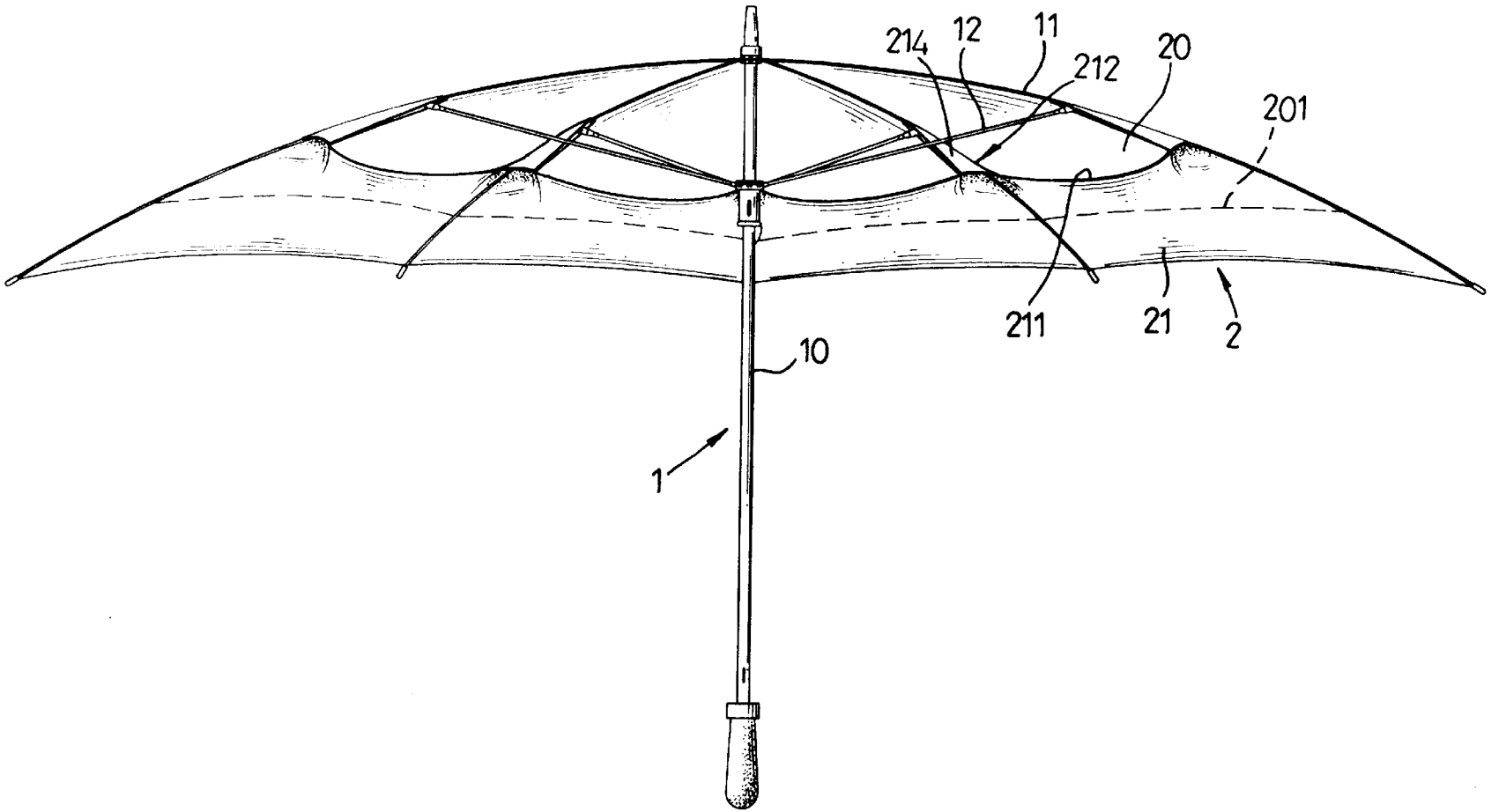
FIG. 2 is a partially cut-away front plan view of the ventilated umbrella as shown in FIG. 1.
Figure 3:
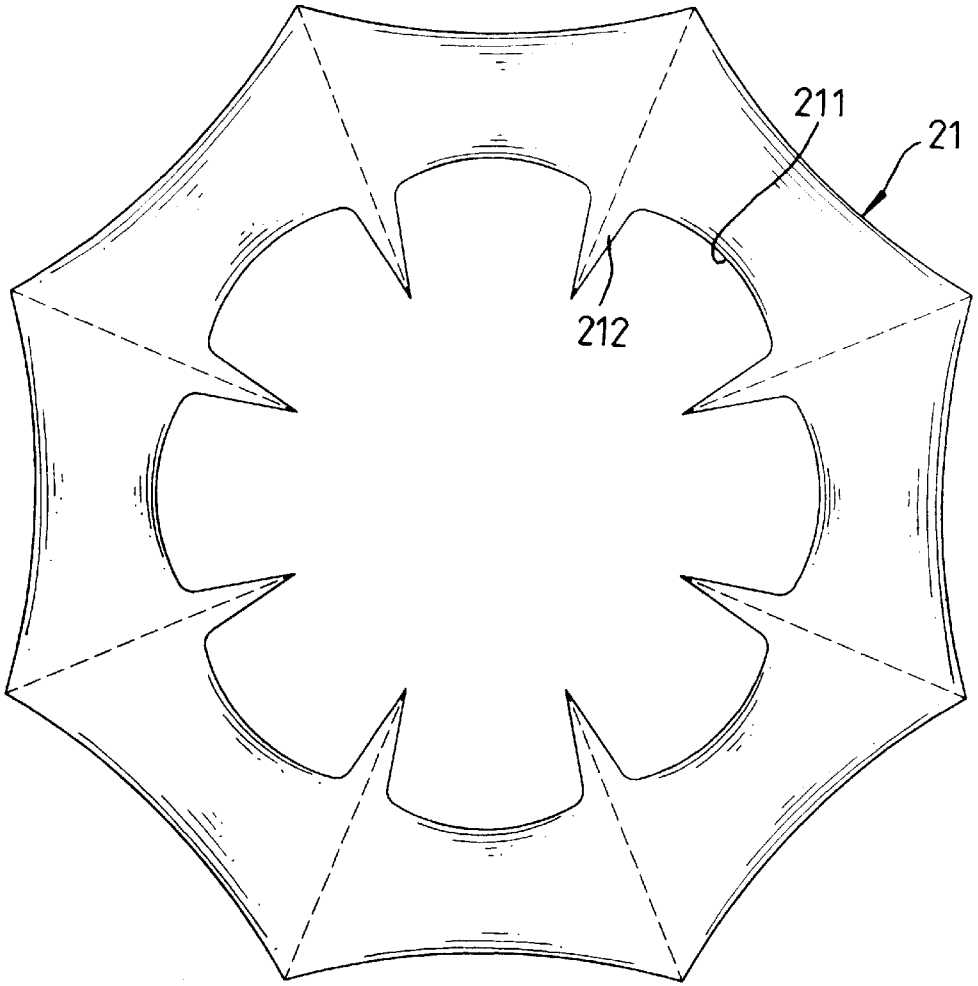
FIG. 3 is a top plan view of the auxiliary canopy of the ventilated umbrella as shown in FIG. 1.

Referring now to FIGS. 1–3, a ventilated umbrella in accordance with the present invention comprises a support frame (1), and a composite canopy (2) attached to the support frame (1).

The support frame (1) includes a shaft (10), multiple ribs (11), and multiple stretchers (12). When the ribs (11) are fully expanded as shown in FIG. 1, the support frame (1) forms a fully expanded surface having a center and an outer edge.

The composite canopy (2) includes a main canopy (20) secured to the support frame (1) and having a dimension smaller than that of the full expanded surface of the support frame (1), and a band-shaped auxiliary canopy (21) secured on the outer edge of the full expanding surface of the support frame (1) and partially overlapped by the main canopy (20).

The auxiliary canopy (21) is located under the main canopy (20), and has the inner edge (211) located nearer the shaft that the outer edge (201) of the main canopy (20). The auxiliary canopy (21) has multiple extensions strips (212) each radially extending inward from the inner edge (211) thereof along a rib (11), and each secured to the corresponding rib (11) of the support frame (1). Each of the extension strips (212) has a tapered shape which tapers toward the center of the second canopy (21) as shown in FIG. 3.

In assembly, the main canopy (20) covers the inner area of the full expanded surface of the support frame (1), and the auxiliary canopy (21) then covers the outer area of the fully expanded surface of the support frame (1) and is partially overlapped by the main canopy (20), with the inner edge (211) of the auxiliary canopy (21) located inside of and under the outer edge (201) of the main canopy (20). Each of the extension strips (212) is then folded and attached to the respective rib (11) of the support frame (1) by stitching, thereby forming a folded portion (214) as shown in FIG. 1. Each of the extension strips (212) of the auxiliary canopy (21) also has its tip secured to the main canopy (20), thereby attaching the auxiliary canopy (21) to the main canopy (20).

In operation, when the support frame of the ventilated umbrella is fully expanded, the folded portion (214) of each of the extension strips (214) is tensioned and stretched by means of the drawing action between the main canopy (20) and the auxiliary canopy (21), thereby enlarging the gaps (not shown) defined between the outer edge (201) of the main canopy (20) and the inner edge (211) of the auxiliary canopy (21) such that the rate of air flowing through the gap is increased so as to enhance the convective effect of the air flowing into the main canopy (20), thereby increasing the ventilation effect of the ventilated umbrella.

In such a manner, the ventilating effect of the ventilated umbrella is greatly enhanced by the folded portion (214) of the extension strips (212) on the auxiliary canopy (21). In addition, the main canopy (20) overlaps the auxiliary canopy (21) only slightly, thereby reducing the cost of manufacturing.

Figure 4:
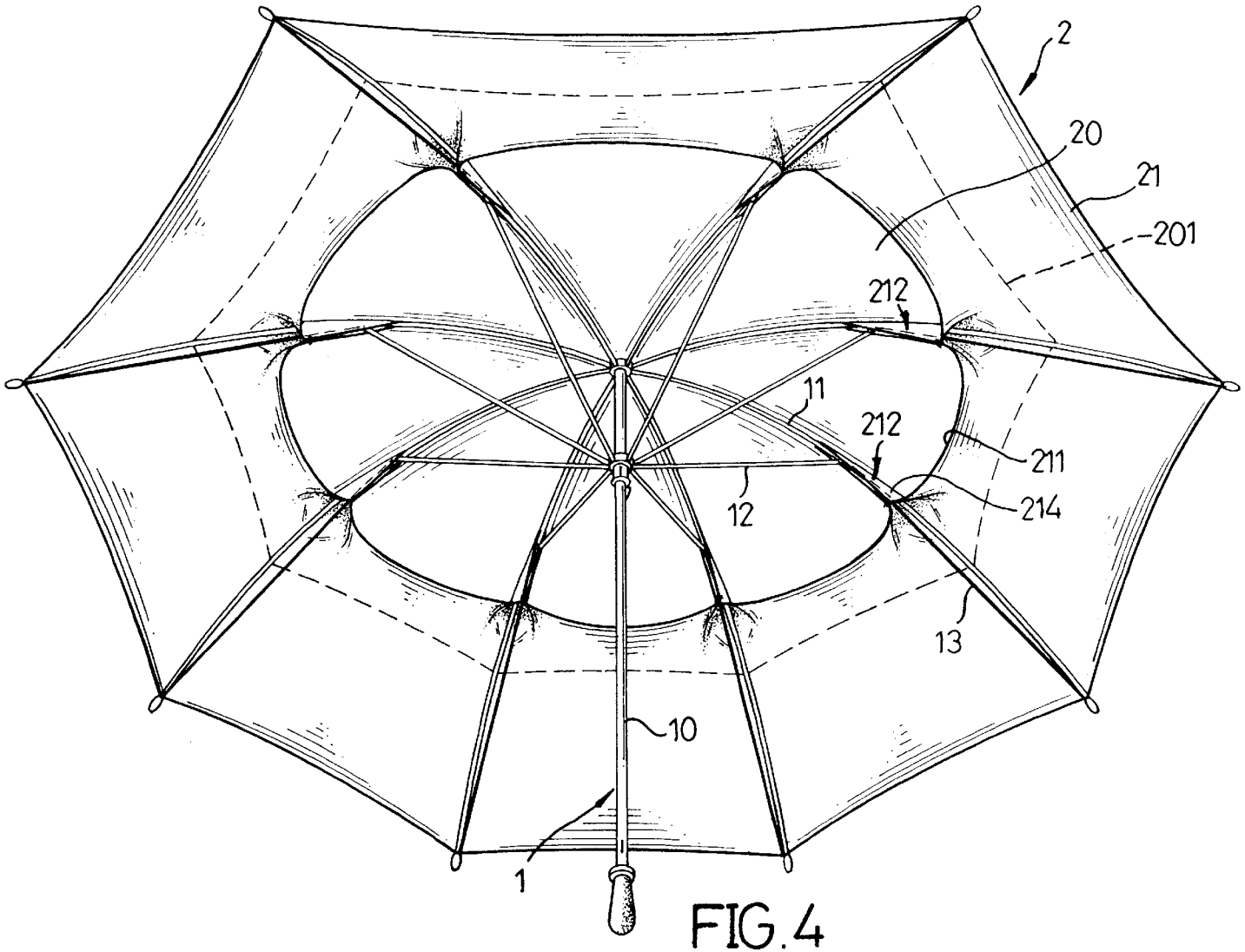
FIG. 4 is a bottom perspective view of the ventilated umbrella that includes multiple reinforcing ropes.

Referring to FIG. 4, the ventilated umbrella further comprises multiple reinforcing ropes (13) each having one end attached to the distal end of one of the corresponding rib (11), and the other end attached to the distal end of the corresponding stretchers (12) so as to reinforce the strength of each of the ribs (11).

Figure 5:
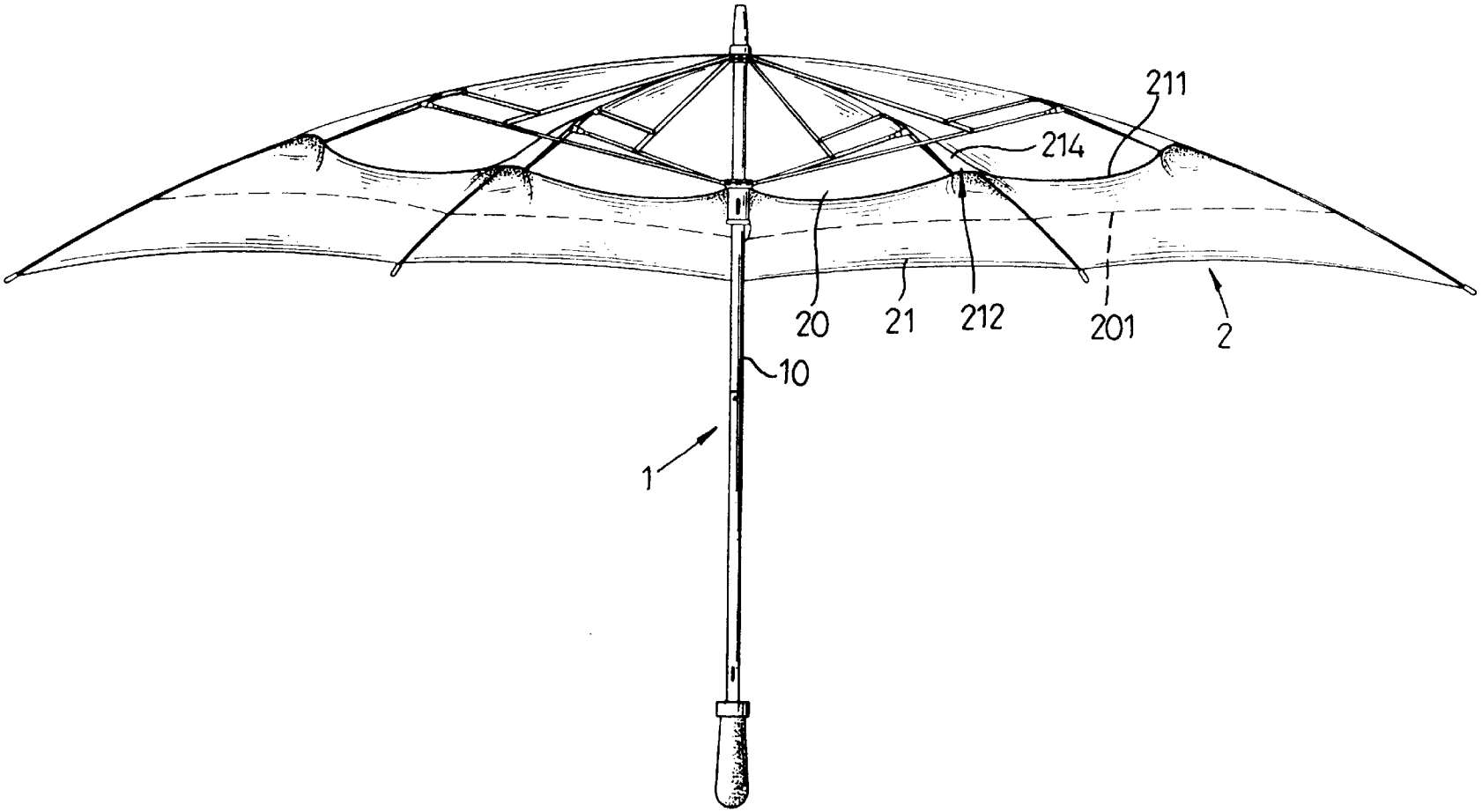
FIG. 5 is a partially cut-away front plan view of the ventilated umbrella in accordance with another embodiment of the present invention.

Referring to FIG. 5, in accordance with another embodiment of the present invention, the support frame (1) has a multi-folding structure such that the ventilated umbrella is foldable.

Figure 6:
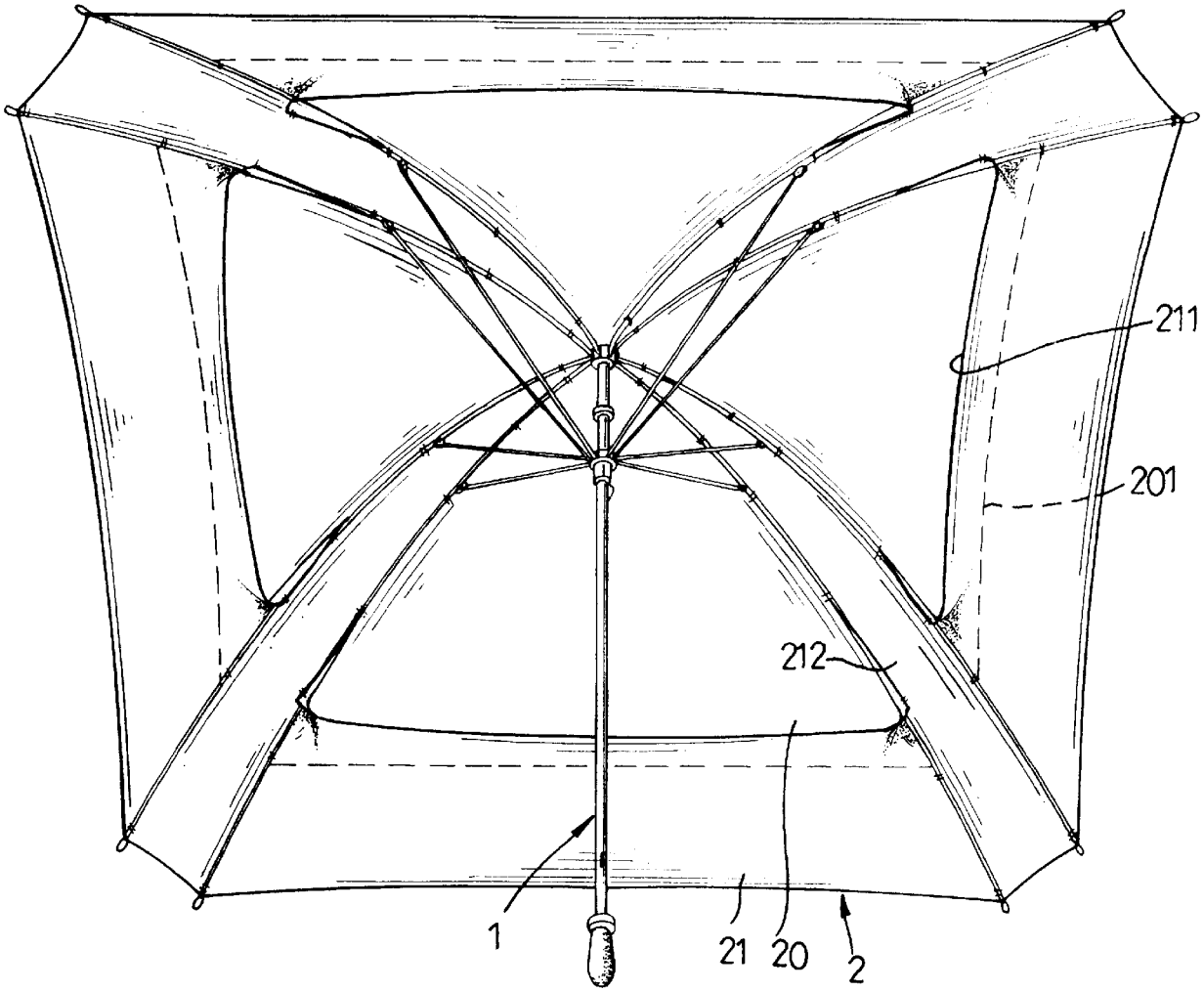
FIG. 6 is a bottom perspective view of a ventilated umbrella in accordance with a further embodiment of the present invention.
Figure 7:
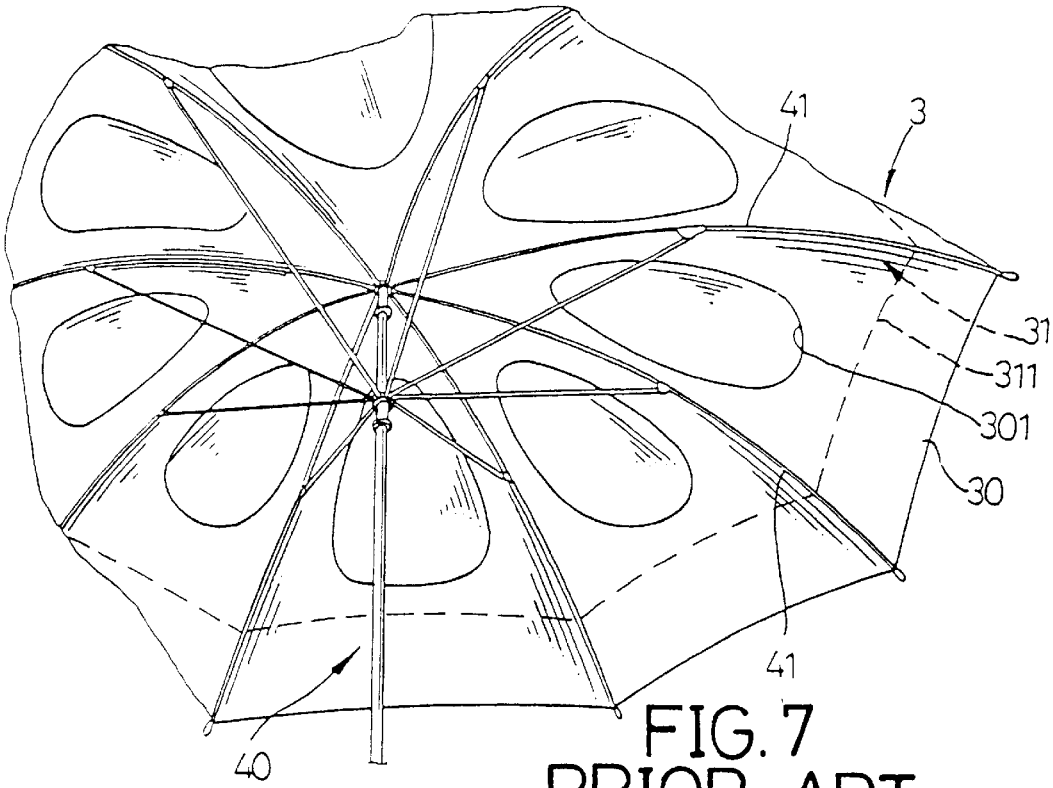
FIG. 7 PRIOR ART
FIG. 7 is a bottom perspective view of a first conventional ventilated umbrella in accordance with the prior art.
Figure 8:
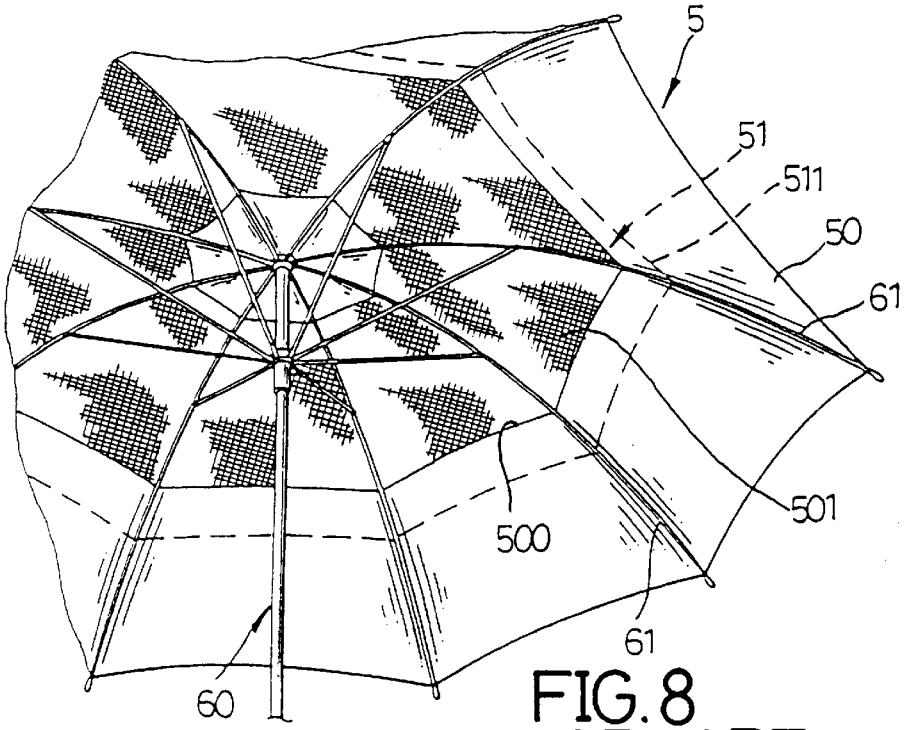
FIG. 8 PRIOR ART
FIG. 8 is a bottom perspective view of a second conventional ventilated umbrella in accordance with the prior art.

Referring to FIG. 6, in accordance with a further embodiment of the present invention, the fully expanded surface of the support frame (1) has a tetragonal shape so as to fit a tetragonal umbrella, and each of the extension strips (212) extends to the center of the auxiliary canopy (21).

It should be clear to those skilled in the art that further embodiments may be made without departing from the scope and spirit of the present invention.

What is claimed is:

1. A ventilated umbrella comprising:

a support frame (1) forming a fully expanded surface when it is fully expanded, said support frame (1) having an inner area and an outer area;

a first canopy (20) secured on said inner area of said fully expanded surface of said support frame (1) and having an outer edge (201); and a band-shaped second canopy (21) secured on said outer area of said fully expanded surface of said support frame (1) and slightly overlapped by said first canopy (20), said second canopy (21) having an inner edge (211) located under said outer edge (201) of said first canopy (20), and having multiple extensions strips (212) each extending inward from said inner edge (211), and each secured to said support frame (1).

2. The ventilated umbrella in accordance with claim 1, wherein said first canopy (23) has a dimension smaller than that of said fully expanded surface of said support frame (1).

3. The ventilated umbrella in accordance with claim 1, wherein each of said extension strips (212) has a tapered shape that tapers toward the center of said second canopy (21).

4. The ventilated umbrella in accordance with claim 1, further comprising multiple reinforcing ropes (13) attached to said support frame (1).

5. The ventilated umbrella in accordance with claim 1, wherein said support frame (1) has a multi-folding structure.

6. The ventilated umbrella in accordance with claim 1, wherein said fully expanded surface of said support frame (1) has a tetragonal shape, and each of said extension strips (212) extends to the center of said second canopy (21).

* * * * *